US006616468B2

(12) United States Patent
Sakiyama

(10) Patent No.: US 6,616,468 B2
(45) Date of Patent: Sep. 9, 2003

(54) CONNECTOR AND ELECTRIC CONNECTION STRUCTURE

(75) Inventor: Koji Sakiyama, Sakura (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 09/835,317

(22) Filed: Apr. 17, 2001

(65) Prior Publication Data

US 2001/0031565 A1 Oct. 18, 2001

(30) Foreign Application Priority Data

Apr. 17, 2000 (JP) ..... 2000-115442
Jun. 8, 2000 (JP) ..... 2000-172346

(51) Int. Cl.[7] ..... H01R 13/53
(52) U.S. Cl. ..... 439/181
(58) Field of Search ..... 439/38, 39, 40, 439/181

(56) References Cited

U.S. PATENT DOCUMENTS 283,167 A * 8/1883 Thomson ..... 310/221
3,892,461 A * 7/1975 Keto ..... 439/38
4,786,770 A * 11/1988 Hamano et al. ..... 200/147 R
5,837,953 A * 11/1998 Ito et al. ..... 218/30

* cited by examiner

*Primary Examiner*—Javaid H. Nasri
(74) *Attorney, Agent, or Firm*—Sughrue Mion, PLLC

(57) ABSTRACT

A connector comprises a male-type connector having a male-type housing and a male-type terminal housed therein, and a female-type connector having a female-type housing and a female-type terminal housed therein. A pair of permanent magnets is attached to both sides of the inner surface of the male-type housing so as to sandwich the top end portion of the male-type terminal. Due to the magnetic field of the permanent magnets, the arc is diffracted and extended by Lorentz force. Therefore, melting, melting of the terminal portion and occurrence of an automobile fire owing to discharge are prevented.

11 Claims, 6 Drawing Sheets

CONNECTOR AND ELECTRIC CONNECTION STRUCTURE

CROSS-REFERENCE TO RELATED APPLICATIONS

This application is based upon and claims the benefit of priority from the prior Japanese Patent Applications No. 2000-115442, filed Apr. 17, 2000; and No. 2000-172346, filed Jun. 8, 2000, the entire contents of both of which are incorporated herein by reference.

BACKGROUND OF THE INVENTION

The present invention relates to a connector and an electric connection structure applicable to a connecting portion of a harness and a connecting portion of a fuse block connected to a load of high power, for use in, for example, an automotive wiring system.

Conventionally, a connector of an automotive wire harness is known as this kind of electric connection structure. The connector is made of a male-type terminal and a female-type terminal, both are formed by pressing a plate-like material of a copper or copper alloy. Usually, the pressed material is plated with tin. An automotive connector terminal, partially plated with silver, is also known.

In recent years, due to environmental issues and requirements for improvement of fuel efficiency, automotive power supply control has been changed from mechanical control to electrical control. For example, a power steering system was conventionally driven by power generated by rotation of the engine. However, an electrical power steering driven by electric power has been also developed. Therefore, although the electric load in an automobile is currently hundreds of watts, it will be increased to few kilowatts. In addition, from the viewpoint of efficiency in electric power supply, it is proposed to boost the source voltage of an automobile from 14V to 42V.

When a load supplied with high power from the boosted power source is operating, if the user inserts or removes a connector of the harness into or from the load, arc discharge may occur at the top end portions of the male-type terminal and the female-type terminal. Energy of the arc discharge may melt the connector terminals. Further, if discharge sparking continues, it may cause an automobile fire.

BRIEF SUMMARY OF THE INVENTION

An object of the present invention is to provide a connector and an electric connection structure, which can prevent arc from occurring at the connector, so that melting of the terminal portion and occurrence of an automobile fire owing to discharge can be prevented.

According to an aspect of the present invention there is provided a connector comprising: a first member incorporating a male-type terminal; a second member incorporating a female-type terminal electrically connectable to the male-type terminal when the first member and the second member are engaged; and a magnet, incorporated in at least one of the first member and the second member, for applying a magnetic field to the male-type terminal and the female-type terminal in a direction perpendicular to a direction in which the male-type terminal and the female-type terminal are inserted.

With the present invention, the magnet applies to the male-type terminal and the female-type terminal the magnetic field in the direction perpendicular to the direction in which the terminals are inserted. Therefore, arc, generated between the terminals when they are engaged, is diffracted and extended by Lorentz force. Consequently, melting of the terminals and occurrence of an automobile fire owing to discharge are prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Preferred embodiments of the present invention will now be described with reference to the accompanying drawings.

Figure 1A:
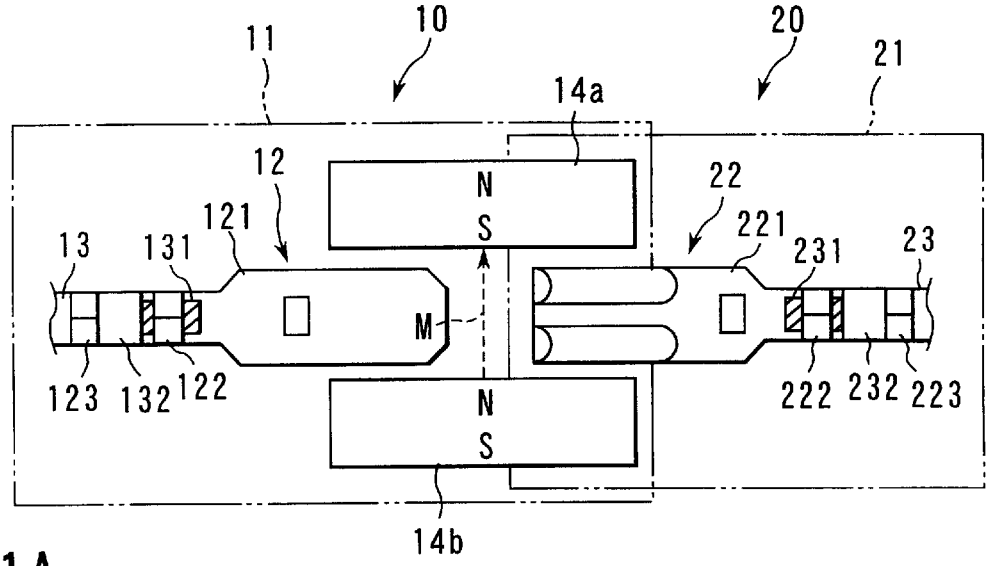
FIG. 1A is a plan view of a connector according to a first embodiment of the present invention.
Figure 1B:
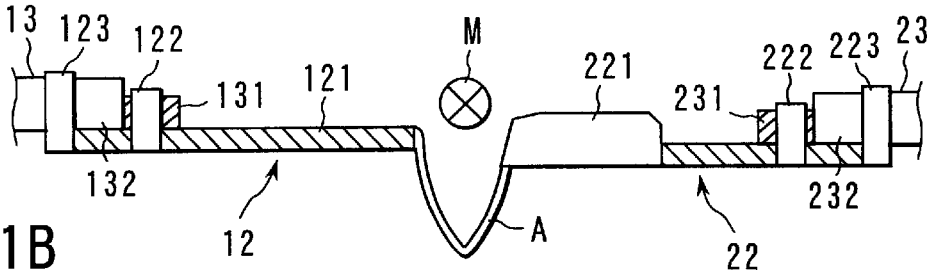
FIG. 1B is a side view of the connector according to the first embodiment.

FIGS. 1A and 1B show a schematic structure of a connector according to a first embodiment of the present invention. FIG. 1A is a plan view and FIG. 1B is a side view.

The connector comprises a male-type connector (first member) 10 and a female-type connector (second member) 20. The male-type connector 10 has a male-type housing 11 and a male-type terminal 12 housed therein, and the female-type connector 20 has a female-type housing 21 and a female-type terminal 22 housed therein. The male-type terminal 12 is made of a plate body of metal, such as copper or brass, which has such a width, length and thickness as to allow the male-type connector 12 to be inserted in the female-type terminal 22. The male-type terminal 12 has a top end connecting portion 121, a conductive wire fixing portion 122 formed at a proximal end portion of the top end connecting portion 121, and a coat fixing portion 123. A conductive wire top end portion 131 of an electric wire 13 is fixed to the conductive wire fixing portion 122 and a coated portion 132 of the electric wire 13 is fixed to the coat fixing portion 123. Permanent magnets 14*a* and 14*b* are attached to both (left and right) sides of the inner surface of the male-type housing 11 so as to sandwich the top end portion of the male-type terminal 12.

The female-type terminal 22 is also made of a plate body of metal, such as copper or brass. It has a top end connecting portion 221, a conductive wire fixing portion 222 and a coat fixing portion 223. The top end connecting portion 221 is shaped such that sides of a top portion thereof is bent inward. The inner surfaces of the bent portions are to be brought into contact with the top end connecting portion 121 of the male-type terminal 122. The conductive wire fixing portion 222 is formed at a distal end portion of the top end connecting portion 221. A conductive wire top end portion 231 of an electric wire 23 is fixed to the conductive wire fixing portion 222 and a coated portion 232 of the electric wire 23 is fixed to the coat fixing portion 223.

With the above structure, when the female-type connector 20 is inserted into or removed from the male-type connector 10, arc A may be formed between the male-type terminal 12 and the female-type terminal 22, as shown in FIG. 1B. In this case, a magnetic field M, in a direction perpendicular to the direction of insertion of the terminals 12 and 22, is formed by the permanent magnets 14*a* and 14*b* between the terminals 12 and 22. Therefore, the locus of the arc A is diffracted by Lorentz force. Since the locus of the arc is thus extended, the terminals 12 and 22 are prevented from melting due to the discharge.

Figure 2:
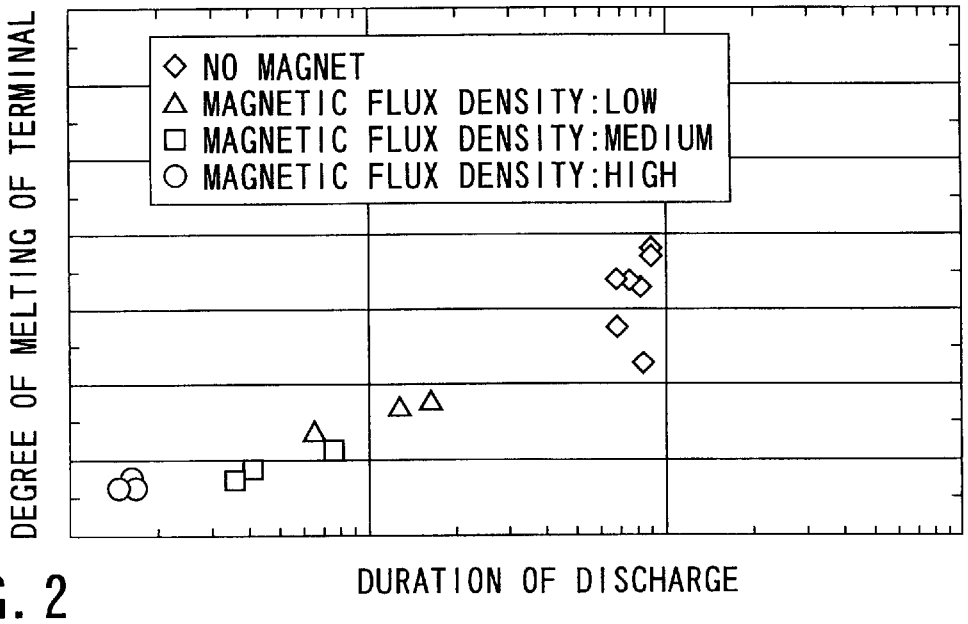
FIG. 2 is a graph showing the relationship among magnetic field strength, duration of discharge and a degree of melting of a terminal.

FIG. 2 is a graph showing the relationship among magnetic field strength, duration of discharge and a degree of melting of a terminal. As is understandable from the graph, when no magnet is used, the duration of discharge is long and the degree of melting of the terminal is high. As the magnetic flux density of the magnetic field supplied to the terminals 12 and 22 is gradually increased from "low" (400G), "middle" (700G) to "high" (1000G), the duration of discharge and the degree of melting of the terminal are both reduced. More specifically, the duration of discharge is reduced to about several percent and the degree of melting is reduced to about ten to several tens of percent.

Figure 3:
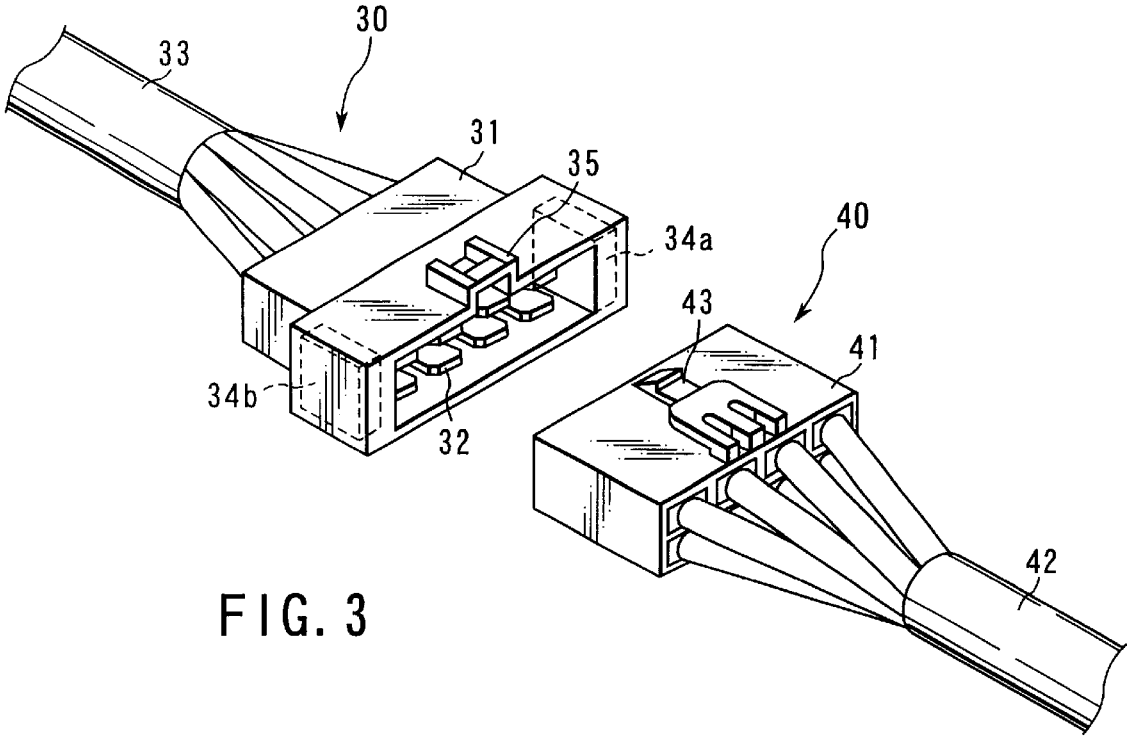
FIG. 3 is a perspective view of a connector according to a second embodiment of the present invention.

FIG. 3 is a perspective view of a connector according to a second embodiment of the present invention.

The connector of the second embodiment also comprises a male-type connector 30 and a female-type connector 40 as in the case of the first embodiment. The male-type connector 30 has a male-type housing 31 and a series of male-type terminals 32 housed therein. As shown in the plan view of FIG. 4, the series of male-type terminals 32 is formed of a comb-shaped insulating base 321 having comb tooth portions 322, and a plurality of conductive members 323 formed by deposition, printing, plating or pasting on the tooth portions 322 and separated from one another. A wire harness 33 is soldered to the proximal ends of the conductive members 323. In this embodiment, two series of male-type terminals 32 are arranged one on another. Permanent magnets 34*a* and 34*b* are attached to the left and right sides of the inner surface of the male-type housing 31 so as to sandwich the series of male-type terminals 32.

The female-type connector 40, like the conventional female-type connector, comprises a female-type housing 41 and female-type terminals (not shown) housed therein. The tooth portions 322 of the series of male-type terminals 32 are inserted in the female-type terminals. Proximal end portions of the female-type terminals are connected to a wire harness 42 by, for example, caulking. In the state where the male-type connector 30 and the female-type connector 40 are engaged, snap engaging portions 35 and 43 of the respective housings 31 and 41 are engaged with each other, so that the connectors may not be disengaged. In this embodiment also, when the male-type connector 30 and the female-type connector 40 are connected to or removed from each other, arc may be formed between the end portions of the series of male-type terminals 32 and the female-type terminals. Since the locus of the arc is diffracted and extended by the magnetic field of the permanent magnets 34*a* and 34*b*, melting of the terminals due to the discharge can be prevented.

Figure 5:
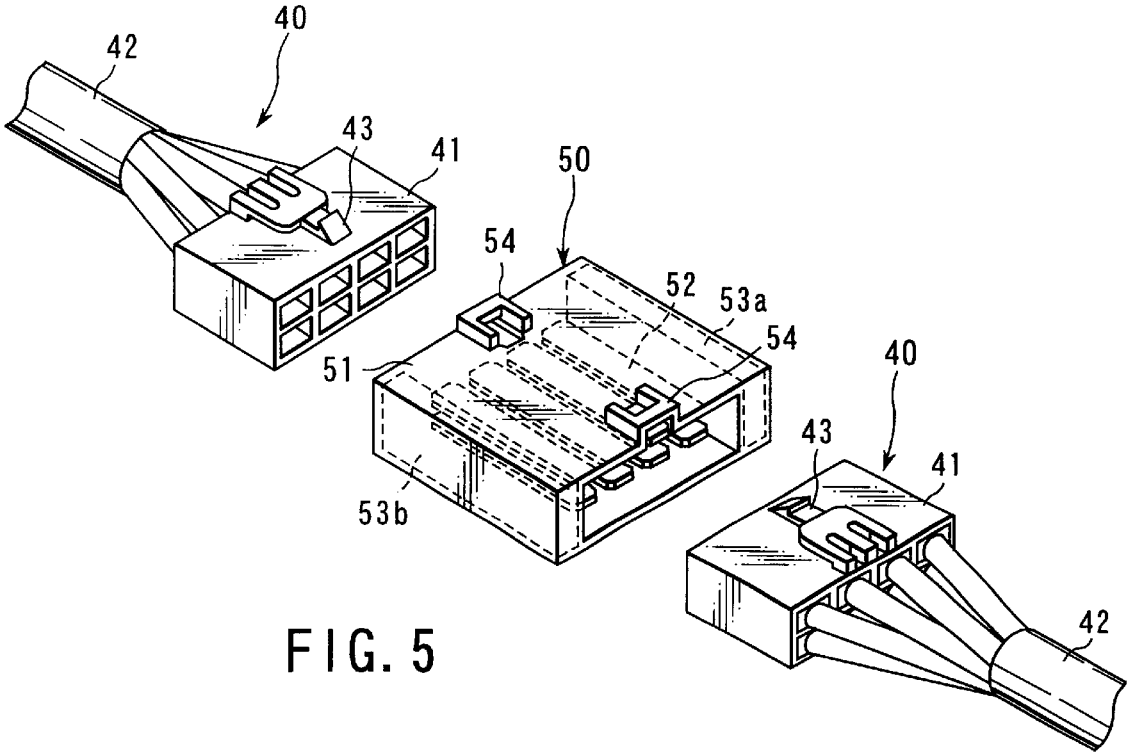
FIG. 5 is a perspective view of a connector according to a third embodiment of the present invention.

FIG. 5 is a perspective view of a third embodiment of the present invention, in which a coupling connector 50 connects two female-type connectors 40 shown in FIG. 3.

Figure 6:
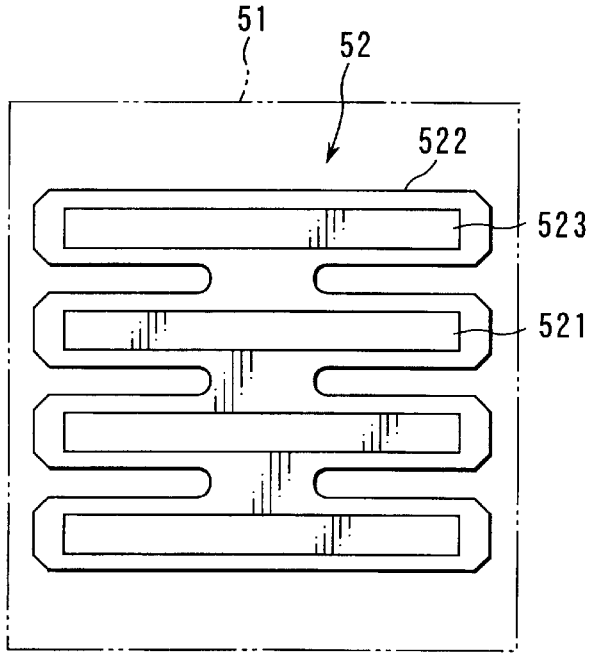
FIG. 6 is a plan view showing a series of male-type terminals incorporated in the connector shown in FIG. 5.

The coupling connector 50 comprises a coupling housing 51 for receiving the female-type connectors at both ends and a series of male-type terminals 52 housed in the coupling housing 51. As shown in FIG. 6, the series of male-type terminals 52 is formed of a comb-shaped insulating base 522 having comb tooth portions 521 at both ends, and a plurality of conductive members 523 formed by deposition, printing, plating or pasting on the tooth portions 522. In this embodiment, two series of male-type terminals 52 are arranged one on another. Permanent magnets 53*a* and 53*b* are attached to the left and right sides of the inner surface of the coupling housing 51 so as to sandwich the series of male-type terminals 52. The coupling housing 51 has snap engaging portions 54 to be engaged with the snap engaging portions 43 of the female-type housings 41 in the state where the coupling connector 50 is engaged with the female-type connectors 40.

In this embodiment also, since the locus of the arc is diffracted by the magnetic field generated between the terminals as in the case of the first and second embodiments, the influence of the discharge can be suppressed.

Figure 7:
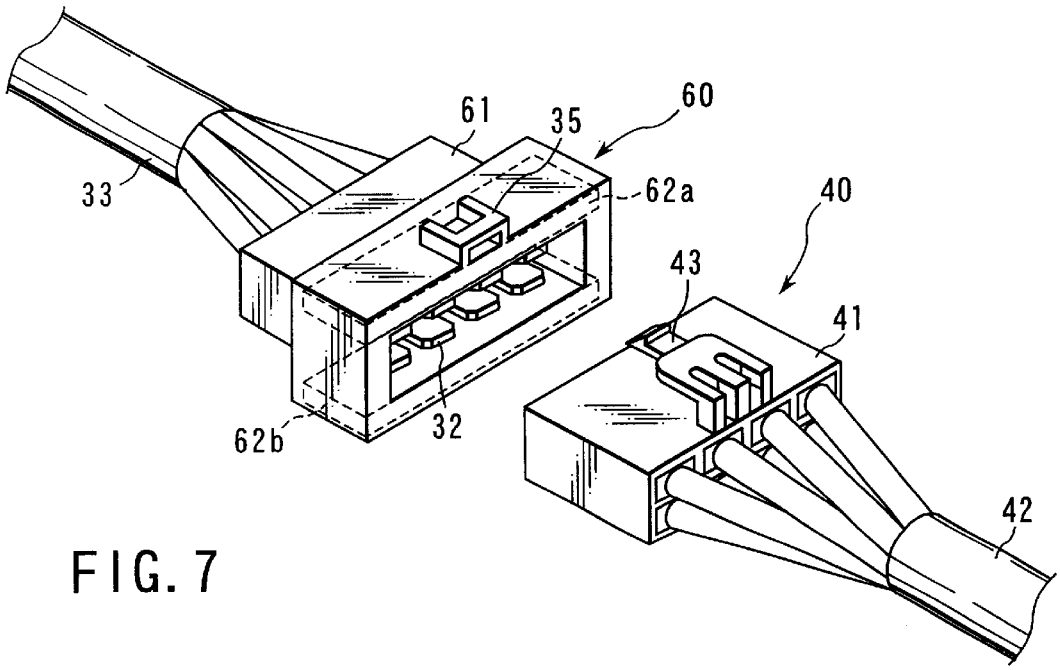
FIG. 7 is a perspective view of a connector according to a fourth embodiment of the present invention.

FIG. 7 is a perspective view of a connector according to a fourth embodiment of the present invention.

Figure 4:
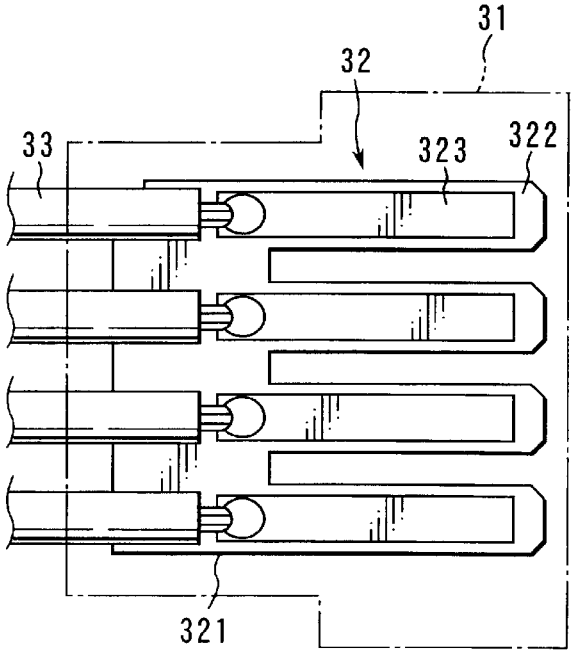
FIG. 4 is a plan view showing a series of male-type terminals incorporated in the connector shown in FIG. 3.

A male-type connector 60 comprises a male-type housing 61 and the series of male-type terminals 32 as shown in FIG. 4 incorporated in the housing. Permanent magnets 62*a* and 62*b* are attached to the upper and lower sides of the inner surface of the male-type housing 61, so that a magnetic field can be applied to the male-type terminal 32 from above and below. The other elements are the same as those shown in FIG. 3, and detailed descriptions thereof will be omitted. In this embodiment, the arc is diffracted in the horizontal direction. In this case also, since the locus of the arc is extended as in the first to third embodiments, the influence of the discharge can be suppressed.

Figure 8A:
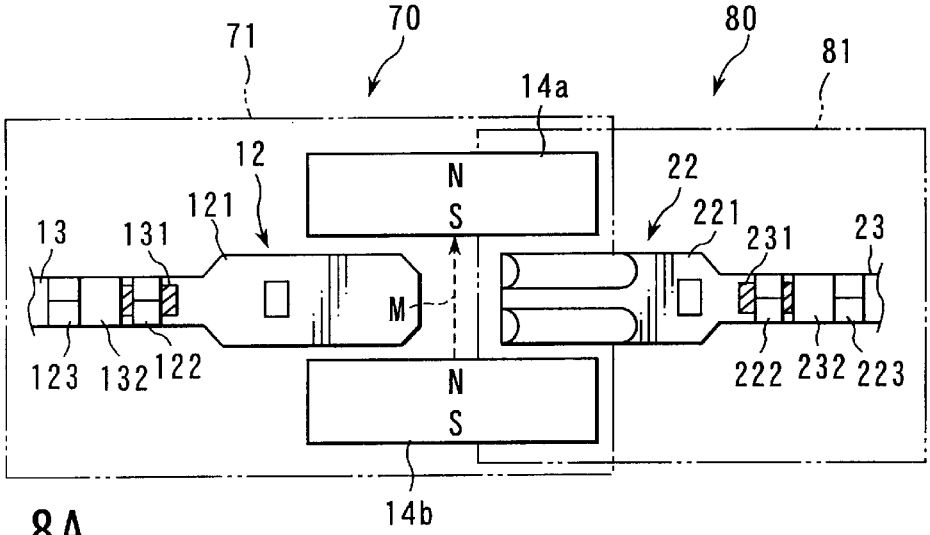
FIG. 8A is a plan view of a connector according to a fifth embodiment of the present invention.
Figure 8B:
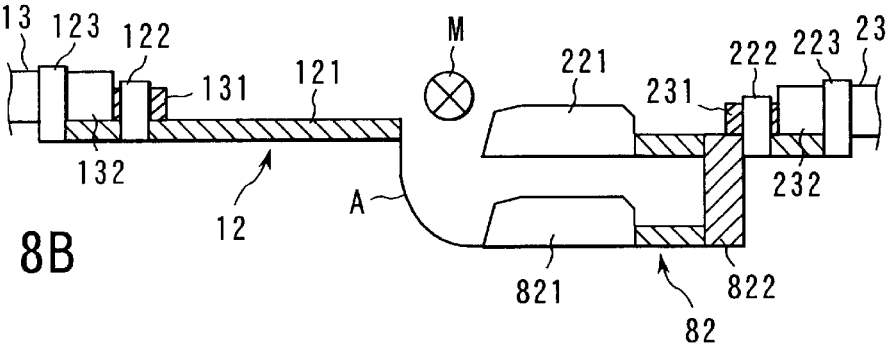
FIG. 8B is a side view of the connector according to the fifth embodiment.

FIGS. 8A and 8B show a schematic structure of a connector according to a fifth embodiment of the present invention. FIG. 8A is a plan view and FIG. 8B is a side view.

As shown in FIG. 8B, the connector of the fifth embodiment comprises a female-type connector 80, corresponding to the female-type connector 20 shown in FIG. 1, which has a female-type housing 81. The female-type housing 81 houses a dummy terminal 82 arranged under the female-type terminal 22 shown in FIG. 1. The dummy terminal 82 has a top end connecting portion 821 whose shape is the same as that of the top end connecting portion 221 of the female-type terminal 22, and a proximal end portion 822 electrically and physically connected to the female-type terminal 22.

With the constitution of this embodiment, when the female-type connector 80 is inserted into or removed from the male-type housing 71 of the male-type connector 70, arc A may be formed between the male-type terminal 12 and the female-type terminal 22. In this case, a magnetic field M, in a direction perpendicular to the direction of insertion of the terminals 12 and 22, is formed between the terminals 12 and 22 by the permanent magnets 14*a* and 14*b*. Therefore, the arc A is diffracted by Lorentz force and absorbed by the dummy terminal 82, as shown in FIG. 8B. Since the locus of the arc is thus extended and moved to the dummy terminal 82, the normal terminals 12 and 22 are prevented from melting due to the discharge.

In this embodiment, the current flows from the female-type terminal 22 to the male-type terminal 12, and the magnetic field M is directed from the upper surface of the drawing to the back in FIG. 8B perpendicular to the paper surface. Therefore, the dummy terminal 82 is arranged under the female-type terminal 22 in the drawing. Since the side of the terminal, with which the electrons of the arc A collide, is liable to be damaged in particular, it is preferable that the dummy terminal 82 be arranged in the upstream of the flow of the current as in this embodiment (on the side of the female-type terminal 22 in the embodiment shown in FIG. 8B). However, the dummy terminal 82 may be arranged on the opposite side (on the side of the male-type terminal 12 in this embodiment). In the latter case, the arc A is moved to the side of the dummy terminal 82. The dummy terminal is arranged on the side to which the arc A is diffracted by the magnetic field M. Therefore, if the direction of the magnetic field M is opposite to that of this embodiment (i.e., if the magnetic field M is directed from the back surface of the drawing to the upper surface in FIG. 8B), the dummy terminal 82 should be arranged above the female-type terminal 22 shown in FIG. 8B. It is preferable that the permanent magnets 14*a* and 14*b* be set so that the most intense magnetic field is applied to a portion where the arc A is generated.

Figure 9:
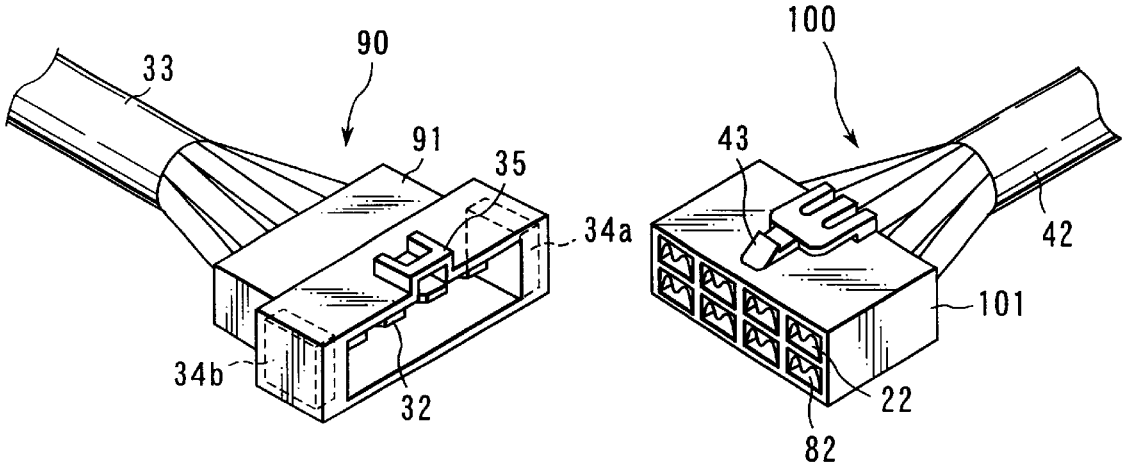
FIG. 9 is a perspective view of a connector according to a sixth embodiment of the present invention.

FIG. 9 is a perspective view of a connector according to a sixth embodiment of the present invention.

As in the second embodiment shown in FIG. 3, the connector of the sixth embodiment comprises a male-type connector 90 and a female-type connector 100 that can be engaged with the male-type connector 90. The male-type connector 90 has a male-type housing 91, which incorporates a series of male-type terminals 32. The proximal end of the series of male-type terminals 32 is soldered to the wire harness 33, as shown in the plan view of FIG. 4. Although the embodiment shown in FIG. 3 has the upper and lower series of male-type terminals, the sixth embodiment has only one series of male-type terminals corresponding to the upper line shown in FIG. 3. Permanent magnets 34*a* and 34*b* are attached to the left and right sides of the inner surface of the male-type housing 91 so as to sandwich the series of male-type terminals 32.

The female-type connector 100 comprises a female-type housing 101 and female-type terminals 22 and dummy terminals 82 housed therein. The tooth portions 322 of the series of male-type terminals 32 are inserted in the female-type terminals 22. Proximal end portions of the female-type terminals 22 are connected to a wire harness 42 by, for example, caulking. The dummy terminals 82 are arranged under the female-type terminals 22 and electrically connected thereto. In this embodiment also, when the male-type connector 90 and the female-type connector 100 are connected to or removed from each other, arc may be formed between the end portions of the series of male-type terminals 32 and the female-type terminals 22. Since the locus of the arc is diffracted by the magnetic field of the permanent magnets 34*a* and 34*b* and the arc is moved to the dummy terminals 82. As a result, melting of the terminals 32 and 22 due to the discharge can be prevented.

Figure 10:
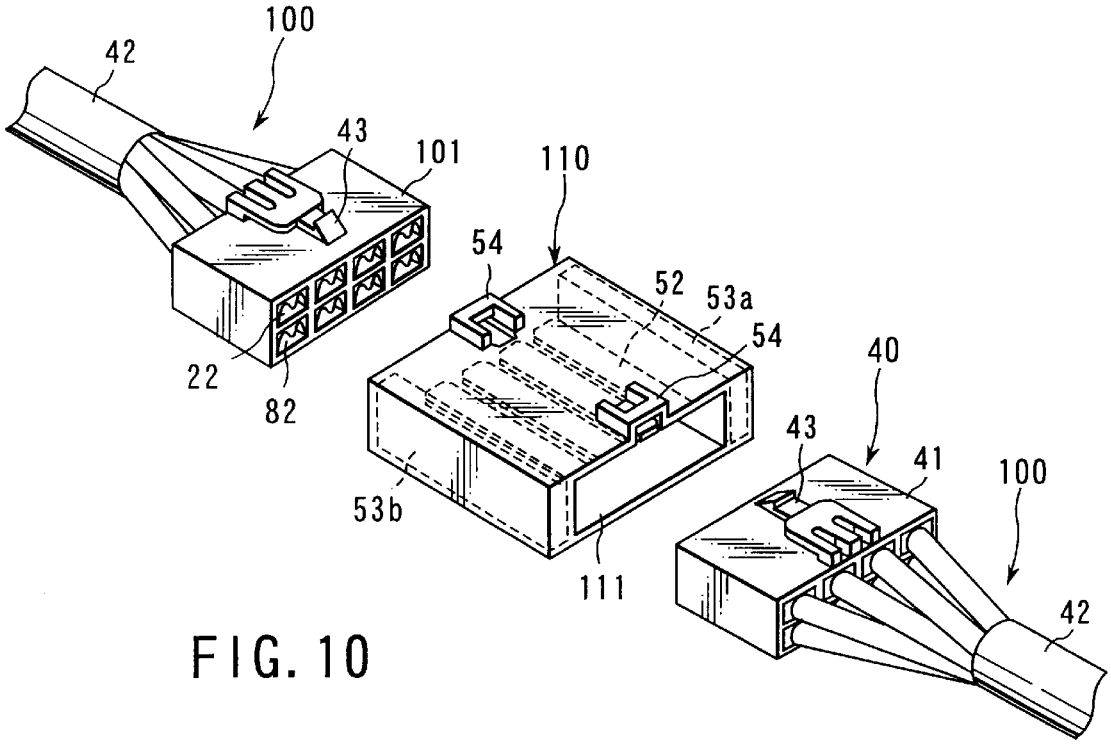
FIG. 10 is a perspective view of a connector according to a seventh embodiment of the present invention.

FIG. 10 is a perspective view of a seventh embodiment of the present invention, in which a coupling connector 110 connects two female-type connectors 100 shown in FIG. 9.

The coupling connector 110 comprises a coupling housing 111 which houses a series of male-type terminals 52, having male-type terminals on both sides, as shown in FIG. 6. Although the embodiment shown in FIG. 5 has the upper and lower series of male-type terminals, the seventh embodiment has only one series of male-type terminals corresponding to the upper line shown in FIG. 5. Permanent magnets 53*a* and 54*b* are attached to the left and right sides of the inner surface of the male-type housing 111 so as to sandwich the series of male-type terminals 52.

As in the above embodiment, since the arc formed between the terminals 52 and 22 is diffracted by the magnetic field and moved to the dummy terminals 82, the influence of the discharge between the terminals 32 and 22 can be prevented.

Figure 11A:
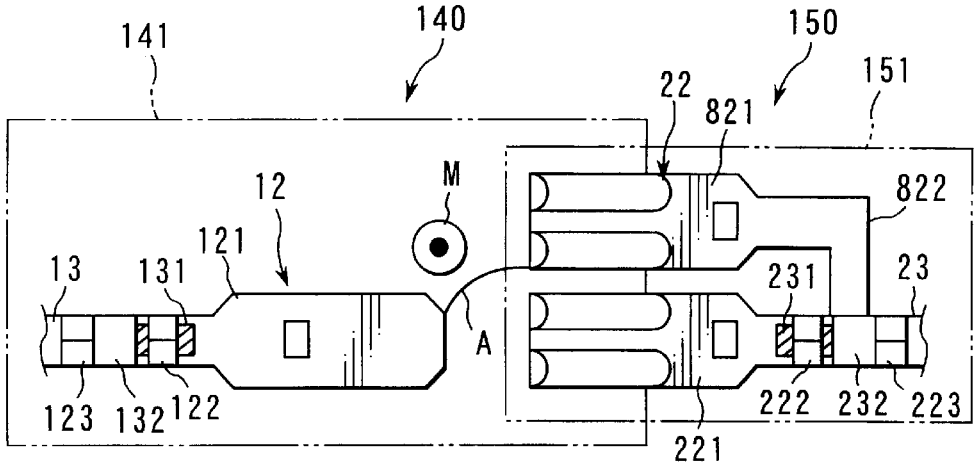
FIG. 11A is a plan view of a connector according to an eighth embodiment of the present invention.
Figure 11B:
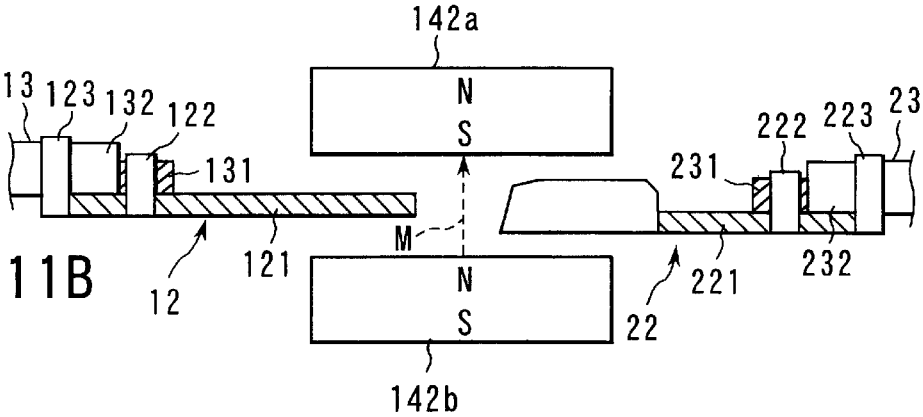
FIG. 11B is a side view of the connector according to the eighth embodiment.

FIGS. 11A and 11B show a schematic structure of a connector according to an eighth embodiment of the present invention. FIG. 11A is a plan view and FIG. 11B is a side view.

The connector comprises a male-type connector (first member) 140 and a female-type connector (second member) 150. The male-type connector 140 has a male-type housing 141 and a male-type terminal 12 housed therein, and the female-type connector 150 has a female-type housing 151 and a female-type terminal 22 housed therein. The male-type terminal 12 has the same structure as that of the first embodiment. Permanent magnets 142*a* and 142*b* are attached to the upper and lower sides of the inner surface of the male-type housing 141, so as to sandwich a top end connecting portion 121 of the male-type terminal 32 from above and below.

The female-type terminal 22 has the same structure as that of the first embodiment. The female-type housing 151 houses a dummy terminal 82 arranged to the right of the female-type terminal 22 facing toward the male-type terminal 12, as shown in FIG. 11A. The dummy terminal 82 has a top end connecting portion 821 whose shape is the same as that of the top end connecting portion 221 of the female-type terminal 22, and a proximal end portion 822 electrically and physically connected to the female-type terminal 22.

In this embodiment, a magnetic field M is formed between the terminals 12 and 22 by the permanent magnets 142*a* and 142*b* in a direction perpendicular to the direction of insertion of the terminals 12 and 22 (upward in FIG. 11B). Therefore, the arc A is diffracted by Lorentz force and absorbed by the dummy terminal 82. Consequently, as in the fifth embodiment, the normal terminals 12 and 22 are prevented from melting due to the discharge.

Figure 12:
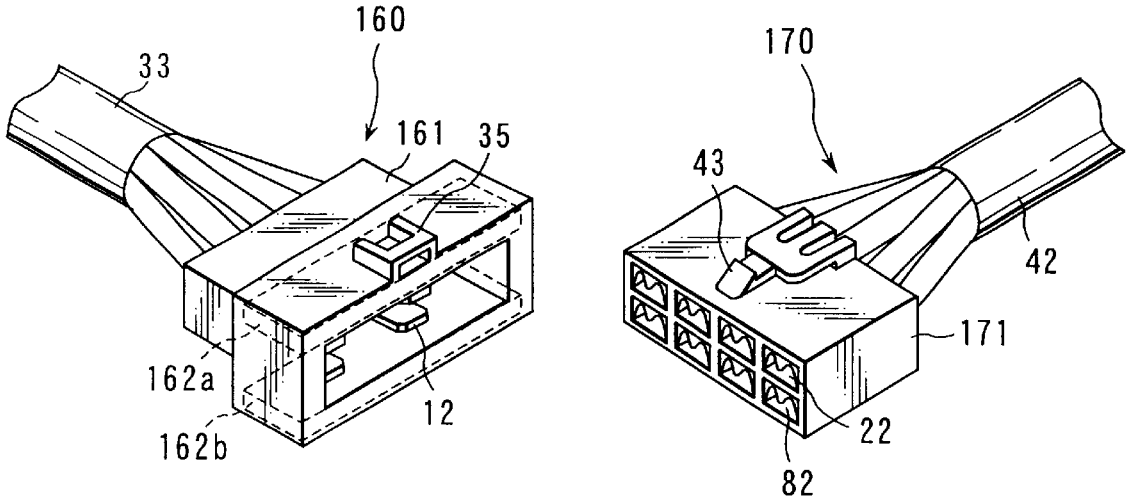
FIG. 12 a perspective view of a connector according to a ninth embodiment of the present invention.

FIG. 12 a perspective view of a connector according to a ninth embodiment of the present invention, which comprises a plurality of male-type terminals 12 and a plurality of female-type terminals 22 of the above embodiment.

The connector of the ninth embodiment comprises a male-type connector 160 having a male-type housing 161 and a female-type connector 170 having a female-type housing 171. The male-type housing 161 incorporates a plurality of male-type terminals 12 the same as that shown in FIG. 11A. The female-type housing 171 incorporates a plurality of female-type terminals 22 and dummy terminals 82, as shown in FIG. 11A. Permanent magnets 162*a* and 162*b* are attached to the upper and lower sides of the inner surface of the male-type housing 161, so that a magnetic field can be applied to the male-type terminal 12 from above and below. In the female-type housing 171 of the female-type connector 170, the female-type terminals 22 and the dummy terminals 82 are arranged alternately in the horizontal direction. Further, sets of the female-type terminal 22 and the dummy terminal 82 are arranged one on another on two levels. The other elements are the same as those shown in FIG. 9. Therefore, the same elements are identified by the same reference numerals as those used in FIG. 9 and detailed descriptions thereof will be omitted.

In the above embodiments, permanent magnets are used as means for extending the locus of an arc. However, electromagnets may be used to apply a magnetic field to top end portions of the terminals. If the intensity of the magnetic field is set suitably, it may be unnecessary to use a pair of magnets as in the above embodiments, and only one magnet may suffice. Further, the present invention is not limited to the connector as described above, but applicable to any electrical connecting structure connected to a load of high power, such as a connecting portion for connecting a fuse block and a fuse.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A connector comprising:

a first member incorporating a male-type terminal having a connecting part;

a second member incorporating a female-type terminal having a connecting part electrically connectable to the connecting part of the male-type terminal when the first member and the second member are engaged; and a magnet, incorporated in at least one of the first member and the second member, for applying a magnetic field to the male-type terminal and the female-type terminal in a direction perpendicular to a direction in which the male-type terminal and the female-type terminal are inserted, said magnetic field being formed between the connecting part of the male-type terminal and the connecting part of the female-type terminal when said terminals are connected or removed from one another.

2. A connector according to claim 1, wherein the magnet comprises a pair of permanent magnets, which is incorporated in at least one of the first member and the second member so as to sandwich at least one of the male-type terminal and the female-type terminal.

3. A connector according to claim 1, wherein the magnet comprises a pair of electromagnets, which is incorporated in at least one of the first member and the second member so as to sandwich at least one of the male-type terminal and the female-type terminal.

4. A connector according to claim 1, further comprising a dummy terminal electrically connected to and arranged along at least one of the male-type terminal and the female-type terminal on a side toward which electrons traveling between the male-type terminal and the female-type terminal are moved by magnetic force of the magnetic field.

5. A connector according to claim 4, wherein the magnet comprises a pair of permanent magnets, which is incorporated in at least one of the first member and the second member so as to sandwich at least one of the male-type terminal and the female-type terminal.

6. A connector according to claim 4, wherein the magnet comprises a pair of electromagnets, which is incorporated in at least one of the first member and the second member so as to sandwich at least one of the male-type terminal and the female-type terminal.

7. A connector according to claim 4, wherein the dummy terminal is arranged along one of the male-type terminal and the female-type terminal that is located upstream of a current.

8. A connector according to claim 7, wherein the magnet comprises a pair of permanent magnets, which is incorporated in at least one of the first member and the second member so as to sandwich at least one of the male-type terminal and the female-type terminal.

9. A connector according to claim 7, wherein the magnet comprises a pair of electromagnets, which is incorporated in at least one of the first member and the second member so as to sandwich at least one of the male-type terminal and the female-type terminal.

10. An electric connecting structure comprising:

a male-type terminal having a connecting part;

a female-type terminal having a connecting part electrically connected to the connecting part of the male-type terminal; and a magnet for applying a magnetic field to the male-type terminal and the female-type terminal in a direction perpendicular to a direction in which the male-type terminal and the female-type terminal are inserted, said magnetic field being formed between the connecting part of the male-type terminal and the connecting part of the female-type terminal when said terminals are connected or removed from one another.

11. An electric connecting structure according to claim 10, further comprising a dummy terminal electrically connected to and arranged along at least one of the male-type terminal and the female-type terminal on a side toward which electrons traveling between the male-type terminal and the female-type terminal are moved by magnetic force of the magnetic field.

* * * * *